US010557435B2

(12) United States Patent
Nakajima et al.

(10) Patent No.: US 10,557,435 B2
(45) Date of Patent: Feb. 11, 2020

(54) FUEL INJECTION CONTROL DEVICE FOR INTERNAL-COMBUSTION ENGINE

(71) Applicant: HONDA MOTOR CO., LTD., Tokyo (JP)

(72) Inventors: Masatoshi Nakajima, Wako (JP); Yujiro Tsutsumi, Wako (JP); Junya Iino, Wako (JP); Kentaro Miki, Wako (JP); Toru Nakashima, Wako (JP); Keita Kamase, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/176,158

(22) Filed: Oct. 31, 2018

(65) Prior Publication Data

US 2019/0128209 A1 May 2, 2019

(30) Foreign Application Priority Data

Oct. 31, 2017 (JP) ..... 2017-210070

(51) Int. Cl.

| | |
|---|---|
| ***F02D 41/38*** | (2006.01) |
| ***F02D 41/12*** | (2006.01) |
| *F02D 41/04* | (2006.01) |
| *F02D 41/18* | (2006.01) |

(52) U.S. Cl.

CPC ..... *F02D 41/38* (2013.01); *F02D 41/12* (2013.01); *F02D 41/3845* (2013.01); *F02D 41/045* (2013.01); *F02D 41/18* (2013.01); *F02D 2041/389* (2013.01); *F02D 2250/31* (2013.01)

(58) Field of Classification Search

CPC ..... F02D 41/38; F02D 41/12; F02D 41/3845; F02D 41/045; F02D 41/18; F02D 2041/389; F02D 2250/31

See application file for complete search history.

(56) References Cited

U.S. PATENT DOCUMENTS 7,124,740 B2 * 10/2006 Nomura ..... F02D 41/1401 123/458

FOREIGN PATENT DOCUMENTS

| | | |
|---|---|---|
| JP | 2007-154686 A | 6/2007 |
| JP | 2016-156317 A | 9/2016 |

* cited by examiner

*Primary Examiner* — Hieu T Vo

(74) *Attorney, Agent, or Firm* — Westerman, Hattori, Daniels & Adrian, LLP

(57) ABSTRACT

In the present disclosure, pressurized fuel is directly injected from a fuel injection valve into a cylinder, and a fuel pressure is controlled to a target fuel pressure. A target fuel pressure during early depressurization is calculated on the basis of a target amount of intake air that is a target load of an internal-combustion engine, a target fuel pressure during a normal state is set on the basis of an actual amount of intake air that is an actual load of the internal-combustion engine, and a lower one of the target fuel pressure during early depressurization and the target fuel pressure during a normal state is set as the target fuel pressure.

8 Claims, 11 Drawing Sheets

| GAIRACT \ NE | NE1 | ····· | NEj |
|---|---|---|---|
| GAIRACT1 | APJUD11 | ····· | APJUD1j |
| ⋮ | ⋮ | ⋱ | ⋮ |
| GAIRACTi | APJUDi1 | ····· | APJUDij |

FUEL INJECTION CONTROL DEVICE FOR INTERNAL-COMBUSTION ENGINE

CROSS REFERENCES TO RELATED APPLICATIONS

The present application claims priority under 35 U.S.C. § 119 to Japanese Patent Application No. 2017-210070, filed Oct. 31, 2017, entitled "Fuel Injection Control Device For Internal-Combustion Engine." The contents of this application are incorporated herein by reference in their entirety.

TECHNICAL FIELD

The present disclosure relates to a fuel injection control device for an internal-combustion engine that directly injects pressurized fuel from a fuel injection valve into a cylinder and controls a pressure of fuel fed to the fuel injection valve to a target fuel pressure.

BACKGROUND

In a case where a direct-injection type fuel injection valve described above is used, typically, fuel is pressurized under high pressure by using a fuel pump and feedback control is performed so that a pressure of fuel (hereinafter simply referred to as a "fuel pressure") fed to the fuel injection valve becomes a target fuel pressure set in accordance with actual rotational speed and load of an internal-combustion engine. Meanwhile, a fuel injection valve has a lower limit valve opening period, and a valve opening period of the fuel injection valve cannot be made shorter than the lower limit valve opening period because of valve opening characteristics of the fuel injection valve. Accordingly, in a case where a load and a target fuel pressure set in accordance with the load rapidly decrease, for example, during deceleration of an internal-combustion engine and where an actual fuel pressure does not follow the target fuel pressure well and does not decrease speedily, there is a possibility that an amount of fuel injection exceeds a requested amount of fuel and fuel is injected excessively in a state where a valve opening period of the fuel injection valve is set to a lower limit valve opening period. Hereinafter, this phenomenon is referred to as "sticking of an injection valve flow amount to a lower limit".

For example, a device described in Japanese Unexamined Patent Application Publication No. 2007-154686 is known as a conventional fuel injection control device that is intended to overcome such a problem. In this device, an amount of fuel injection is calculated in accordance with a rotational speed of an internal-combustion engine and an amount of operation of an accelerator pedal, a target fuel pressure is calculated in accordance with the amount of fuel injection and the rotational speed of the internal-combustion engine, and feedback control is performed so that an actual fuel pressure becomes the target fuel pressure. In a fuel injection control device described in Japanese Unexamined Patent Application Publication No. 2016-156317, a change in load of an internal-combustion engine is predicted, and pressurizing operation of a fuel pump is stopped when it is predicted that the load decrease.

The inventors found that in the device described in Japanese Unexamined Patent Application Publication No. 2007-154686, a target fuel pressure is set in accordance with an amount of operation of an acceleration pedal, and it is therefore possible to speedily decrease an actual fuel pressure in accordance with the target fuel pressure during deceleration. However, for example, in a case where rapid deceleration is performed in the middle of an accelerated state, the actual fuel pressure has been already controlled to a high fuel pressure in accordance with the target fuel pressure in the accelerated state, and therefore the actual fuel pressure cannot be speedily decreased to a desired pressure even when the target fuel pressure is decreased from this state during deceleration. This leads to a risk of occurrence of the aforementioned sticking of an injection valve flow amount to a lower limit.

The inventors found that in the device described in Japanese Unexamined Patent Application Publication No. 2016-156317, pressurizing operation of a fuel pump is stopped when it is predicted that a load of an internal-combustion engine decrease, and it is therefore possible to speedily decrease a fuel pressure during deceleration. However, the fuel pressure cannot be controlled since the pressurizing operation of the fuel pump is completely stopped, and therefore there is a possibility that the fuel pressure decrease more than necessary. In such a case, there is a risk of failure to secure a fuel pressure necessary for re-acceleration after deceleration.

Thus, it is preferable to provide a fuel injection control device for an internal-combustion engine that can speedily decrease a fuel pressure in a right amount in accordance with a load of an internal-combustion engine during deceleration even in a case where deceleration is performed in the middle of an accelerated state, thereby preventing an injection valve flow amount from sticking to a lower limit.

SUMMARY

A fuel injection control device for an internal-combustion engine according to a first aspect of the present disclosure is a fuel injection control device for an internal-combustion engine that directly injects pressurized fuel from a fuel injection valve 10 into a cylinder 3*a* and controls, to a target fuel pressure PFCMD, a fuel pressure PF that is a pressure of fuel fed to the fuel injection valve 10, the fuel injection control device including: a target load acquisition unit (an ECU 2 according to an embodiment (the same applies through this section), Step 51 in FIG. 9) that acquires a target load (a target amount of intake air GAIRCMD) that is a target of a load of the internal-combustion engine 3; a first target fuel pressure setting unit (the ECU 2, Step 17 in FIG. 4, FIG. 9) that sets a first target fuel pressure (a target fuel pressure PFCMD1 during early depressurization) on the basis of the acquired target load; an actual load acquisition unit (an air flow sensor 42) that acquires an actual load (an actual amount of intake air GAIRACT) of the internal-combustion engine 3; a second target fuel pressure setting unit (the ECU 2, Step 11 in FIG. 4, FIG. 5) that sets a second target fuel pressure (a target fuel pressure PFCMD2 during a normal state) on the basis of the acquired actual load; and a fuel pressure control unit (the ECU 2, Steps 18, 15, and 19 in FIG. 4) that performs target fuel pressure control during deceleration (an early depressurization mode) for setting a lower one of the first target fuel pressure and the second target fuel pressure as the target fuel pressure PFCMD during deceleration of the internal-combustion engine 3.

An internal-combustion engine to which the present disclosure is applied is a direct injection type that directly injects pressurized fuel from a fuel injection valve into a cylinder. In this fuel injection control device, a pressure of fuel (fuel pressure) fed to the fuel injection valve is controlled to a target fuel pressure, and the target fuel pressure is set as follows. First, a target load that is a target of a load of the internal-combustion engine is acquired, and a first target fuel pressure is set on the basis of the acquired target load. Furthermore, an actual load of the internal-combustion engine is acquired, and a second target fuel pressure is set on the basis of the acquired actual load. During deceleration of the internal-combustion engine, target fuel pressure control during deceleration for setting, as a final target fuel pressure, a lower one of the first target fuel pressure and the second target fuel pressure is performed.

The target load of the internal-combustion engine is set in good response on the basis of an operation state of the internal-combustion engine, whereas the actual load controlled while using the target load as a target changes later than the target load. Accordingly, during deceleration, the first target fuel pressure set on the basis of the target load generally decreases more speedily than the second target fuel pressure set on the basis of the actual load. In this case, according to the present disclosure, for example, the target fuel pressure is set to the lower first target fuel pressure, and the actual fuel pressure speedily decreases accordingly. This makes it possible to prevent an injection valve flow amount from sticking to a lower limit during deceleration.

A relationship that the first target fuel pressure is higher than the second target fuel pressure is sometimes established in an initial stage of deceleration in a case where an acceleration state is switched to deceleration in the middle of acceleration or in a case where there is a stationary deviation between the target load and the actual load, for example, due to an acquisition error of the actual load. In such a case, according to the present disclosure, for example, the target fuel pressure is set to the lower second target fuel pressure. This makes it possible to more speedily decrease the actual fuel pressure than in a case where the target fuel pressure is set to the first target fuel pressure. Note that "acquire" seen in "acquires a target load" and "acquires an actual load" in the first aspect encompasses direct detection using a sensor and estimation or setting based on another kind of parameter.

In a second aspect, the fuel injection control device according to the first aspect further includes a deceleration determining unit (the ECU 2, Step 13 in FIG. 4, FIG. 7) that determines a deceleration state of the internal-combustion engine 3 on the basis of an amount of decrease (an accelerator position decrease amount ΔAP) of a degree of opening of an accelerator pedal (an accelerator position AP) or an amount of decrease of requested torque TRQ requested for the internal-combustion engine 3, wherein the fuel pressure control unit performs the target fuel pressure control during deceleration in a case where it is determined that the internal-combustion engine 3 is in a deceleration state and sets the target fuel pressure PFCMD to the second target fuel pressure in a case where it is determined that the internal-combustion engine 3 is not in a deceleration state (Steps 14, 15, 18, and 19 in FIG. 4).

According to this configuration, in a case where it is determined that the internal-combustion engine is in a deceleration state, the target fuel pressure control during deceleration is performed in which a lower one of the first target fuel pressure and the second target fuel pressure is set as the target fuel pressure. Meanwhile, in a case where it is determined that the internal-combustion engine is not in a deceleration state, the target fuel pressure is set to the second target fuel pressure. The second target fuel pressure, which is set on the basis of the actual load of the internal-combustion engine, changes in dull and stable manner as compared with the first target fuel pressure set on the basis of the target load. Accordingly, during operation, other than deceleration, in which there is not risk of occurrence of sticking of an injection valve flow amount to a lower limit, stable fuel pressure control based on the actual load can be performed while using the second target fuel pressure as a target fuel pressure.

Furthermore, according to this configuration, a deceleration state is determined on the basis of an amount of decrease of a degree of opening of an accelerator pedal or an amount of decrease of requested torque requested for the internal-combustion engine. In the former case, a deceleration state can be accurately determined while directly reflecting a driver's decelerating intention. Meanwhile, in the latter case, a deceleration state can be more precisely determined on the basis of an amount of decrease of the load of the internal-combustion engine while reflecting a decrease in auxiliary machine load, torque reduction at the time of gear change, or the like. It is therefore possible to more properly prevent an injection valve flow amount from sticking to a lower limit.

In a third aspect, the fuel injection control device according to the first aspect or the second aspect is arranged such that the fuel pressure control unit finishes the target fuel pressure control during deceleration and sets the target fuel pressure PFCMD to the second target fuel pressure in a case where the first target fuel pressure and the second target fuel pressure match each other during the target fuel pressure control during deceleration and where a predetermined period has elapsed after start of the target fuel pressure control during deceleration (Steps 20 to 22 and 15 in FIG. 4, FIG. 12).

According to this configuration, the target fuel pressure control during deceleration is finished and the target fuel pressure is set to the second target fuel pressure on a condition that the first target fuel pressure and the second target fuel pressure match each other during the target fuel pressure control during deceleration. In a case where the deceleration operation is continued for a long period, the second target fuel pressure that decreases later matches the first target fuel pressure. This means that early depressurization has been accomplished by the first target fuel pressure. Accordingly, in this case, the target fuel pressure control during deceleration is finished, and the target fuel pressure is set to the second target fuel pressure. It is therefore possible to switch to stable fuel pressure control based on the actual load.

Furthermore, in a case where re-acceleration is performed in the middle of deceleration, the first target fuel pressure set on the basis of the target load shifts from a state where the first target fuel pressure is lower than the second target fuel pressure to a state where the first target fuel pressure is equal to the second target fuel pressure and then to a state where the first target fuel pressure is higher than the second target fuel pressure, and thus a relationship between the first target fuel pressure and the second target fuel pressure is reversed. In such a case, according to the present disclosure, the condition that the first target fuel pressure and the second target fuel pressure match each other is met in the middle of reversal of the relationship. Accordingly, the target fuel pressure control during deceleration is finished, and the target fuel pressure is set to the second target fuel pressure. It is therefore possible to switch to stable fuel pressure control based on the actual load.

Furthermore, according to the present disclosure, the target fuel pressure control during deceleration is finished not only on a first condition that the first target fuel pressure and the second target fuel pressure match each other, but also on a second condition that a predetermined period has elapsed after start of the target fuel pressure control during deceleration. This makes it possible to avoid, with certainty, a situation in which the target fuel pressure control during deceleration is instantly finished when the first condition is established, in a case where the first target fuel pressure and the second target fuel pressure have not been deviated from each other yet in an initial stage of the target fuel pressure control during deceleration or in a case where the relationship that the first target fuel pressure is lower than the second target fuel pressure is established immediately after shift to deceleration in the middle of acceleration.

In a fourth aspect, the fuel injection control device according to any one of the first through third aspects further includes a first limiting unit (an upper limit guard fuel pressure PFLMTGD, the ECU 2, Steps 53 and 55 in FIG. 9) that limits the first target fuel pressure so that an amount of fuel injection of the fuel injection valve 10 controlled on the basis of the first target fuel pressure does not become lower than an upper limit flow amount of the fuel injection valve 10.

A direct-injection type fuel injection valve has an upper limit valve opening period. A valve opening period cannot be made longer than the upper limit valve opening period due to restrictions such as an injection timing and an injection period especially in a high-load high-rotation state. Accordingly, in a case where the actual fuel pressure decreases more than necessary in an initial stage of deceleration because of the target fuel pressure control during deceleration, there is a possibility that an amount of fuel injection becomes smaller than a requested amount of fuel, i.e., fuel shortage occurs (hereinafter, this phenomenon is referred to as "sticking of an injection valve flow amount to an upper limit") in a state where the valve opening period of the fuel injection valve is set to the upper limit valve opening period.

Meanwhile, according to the present disclosure, the first target fuel pressure is limited so that an amount of fuel injection controlled on the basis of the first target fuel pressure does not become smaller than an upper-limit flow amount of the fuel injection valve. This makes it possible to prevent an injection valve flow amount from sticking to an upper limit with certainty.

In a fifth aspect, the fuel injection control device according to any one of the first through fourth aspects further includes a fuel pressure detection unit (a fuel pressure sensor 41) that detects the fuel pressure PF; a feedback control unit (the ECU 2, Step 2 in FIG. 3) that performs feedback control so that the detected fuel pressure PF becomes the target fuel pressure PFCMD; and a second limiting unit (a U/S prevention guard fuel pressure PFU/SGD, the ECU 2, Steps 54 and 55 in FIG. 9) that limits the first target fuel pressure so that an excessive decrease of the fuel pressure PF relative to the target fuel pressure PFCMD caused by the feedback control is avoided.

According to this configuration, feedback control is performed so that a detected fuel pressure becomes the target fuel pressure, and the first target fuel pressure is limited so that an excessive decrease of a fuel pressure relative to the target fuel pressure by the feedback control is prevented. This makes it possible to avoid an excessive decrease (undershoot) of the actual fuel pressure relative to the target fuel pressure by the feedback control and an excessive increase (overshoot) that occurs in response against undershoot especially in an initial stage of deceleration. It is therefore possible to perform stable feedback control. In the above explanation of the exemplary embodiment, specific elements with their reference numerals are indicated by using brackets. These specific elements are presented as mere examples in order to facilitate understanding, and thus, should not be interpreted as any limitation to the accompanying claims.

BRIEF DESCRIPTION OF THE DRAWINGS

The advantages of the disclosure will become apparent in the following description taken in conjunction with the following drawings.

FIG. 6 illustrates a target fuel pressure map used for calculation of a target fuel pressure during a normal state, a basic target fuel pressure, and the like.

DETAILED DESCRIPTION

Figure 1:
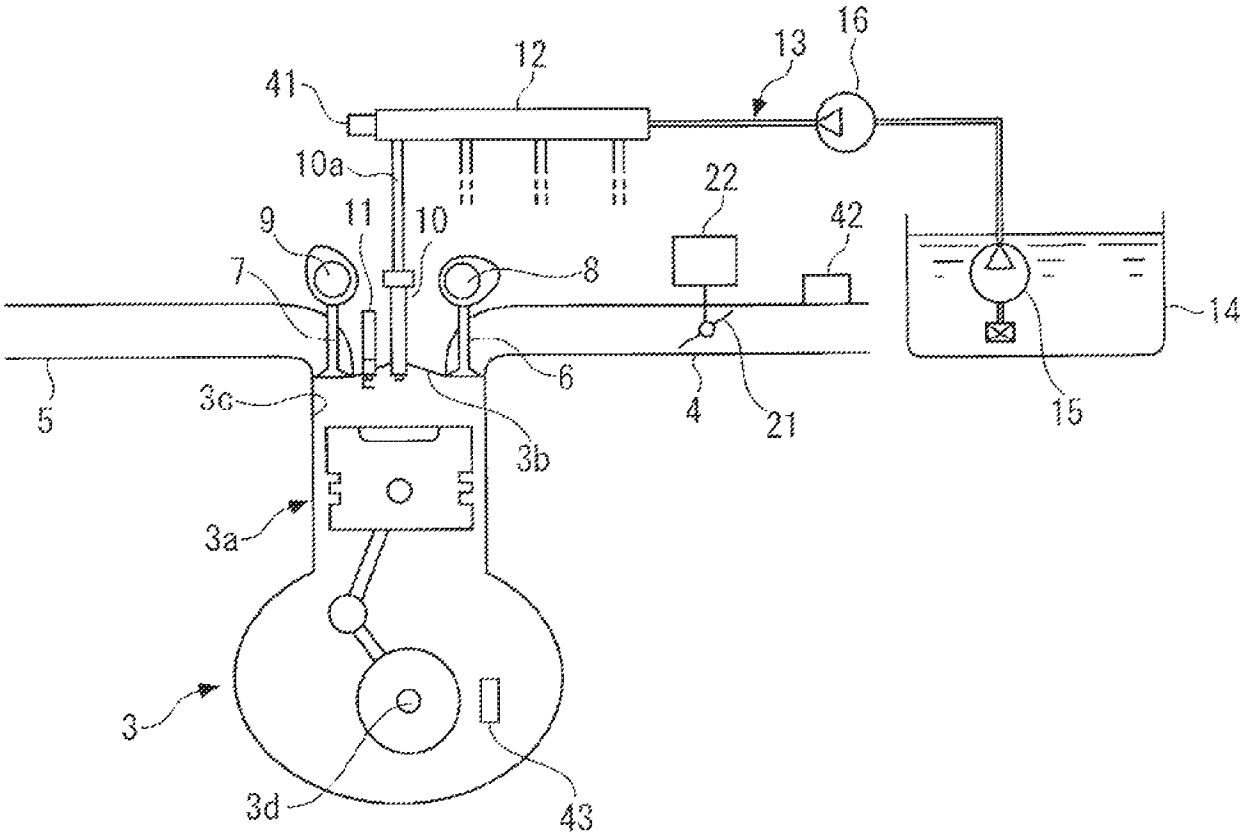
FIG. 1 schematically illustrates a fuel injection control device according to an embodiment together with an internal-combustion engine.
Figure 2:
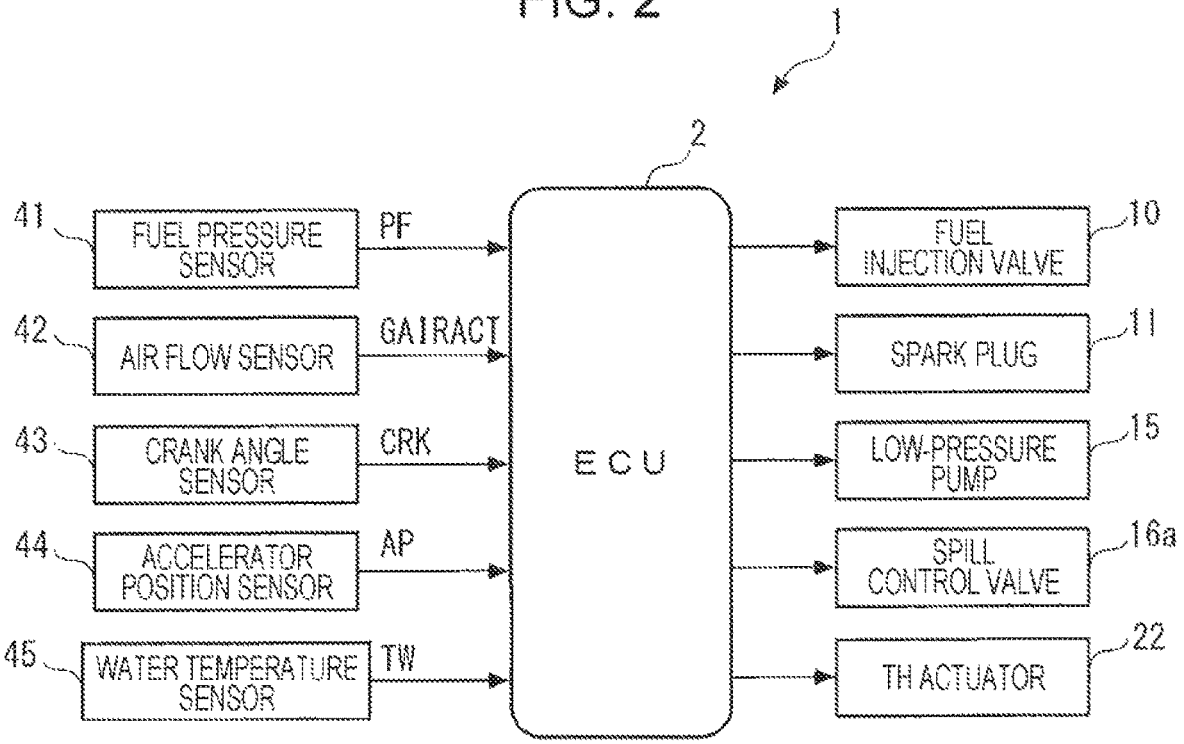
FIG. 2 is a block diagram illustrating the fuel injection control device.

A preferred embodiment is described in detail below with reference to the drawings. As illustrated in FIGS. 1 and 2, a fuel injection control device 1 to which the present disclosure is applied includes an electronic control unit (ECU) 2 and performs various kinds of control processes including control of fuel injection of an internal-combustion engine (hereinafter referred to an "engine") 3.

The engine 3 is, for example, a gasoline engine that has four cylinders 3*a* (only a single cylinder 3*a* is illustrated) and is mounted as a power source in a vehicle (not illustrated). An inlet pipe 4 and an exhaust pipe 5 are connected to each cylinder 3*a*, and an intake valve 6 and an exhaust valve 7 provided at an intake port and an exhaust port are driven by an intake camshaft 8 and an exhaust camshaft 9, respectively.

A fuel injection valve (hereinafter referred to as an "injector") 10 is provided at a center of a cylinder head 3*b* of each cylinder 3*a* and a spark plug 11 is attached adjacent to the injector 10 so that the injector 10 and the spark plug 11 face a combustion chamber 3C. That is, the engine 3 is a direct injection type that directly injects fuel from the injector 10 to the combustion chamber 3C of the cylinder 3*a*. Opening closing operation of the injector 10 and an ignition timing of the spark plug 11 are controlled by the ECU 2.

Each injector 10 is connected to a fuel tank 14 through a fuel feed short pipe 10*a*, a delivery pipe 12, and a fuel feed pipe 13. A low-pressure pump 15 is provided at a most upstream position of the fuel feed pipe 13, and a high-pressure pump 16 is provided in the middle of the fuel feed pipe 13.

The low-pressure pump 15 is electrically-driven type and pressurizes fuel in the fuel tank 14 under a predetermined low pressure and then ejects the fuel to the high-pressure pump 16 side through the fuel feed pipe 13 under control of the ECU 2.

The high-pressure pump 16 is a mechanically-driven type that is driven by a pump driving cum (not illustrated) that is integral with the exhaust camshaft 9, and the high-pressure pump 16 further pressurizes fuel fed from the low-pressure pump 15 under a high pressure and then ejects the fuel to the delivery pipe 12 side through the fuel feed pipe 13. The high-pressure fuel accumulated in the delivery pipe 12 is fed to the injector 10 through the fuel feed short pipe 10*a* and is then injected to the combustion chamber 3C by opening of the injector 10.

The high-pressure pump 16 includes a spill control valve 16*a* (see FIG. 2). The spill control valve 16*a* is an electromagnetic valve and controls spill operation for causing fuel taken into the high-pressure pump 16 to flow back to the low-pressure side. More specifically, a spill amount of fuel is adjusted by controlling a closing timing of the spill control valve 16*a* by using the ECU 2, and thus an amount of ejection of fuel to the delivery pipe 12 and a pressure of fuel (hereinafter referred to as a "fuel pressure") PF in the delivery pipe 12 are controlled.

According to the configuration, an amount of fuel injection of the injector 10 is controlled in accordance with an opening period of the injector 10 controlled by the ECU 2 and the fuel pressure PF. The fuel pressure PF accumulated in the delivery pipe 12 cannot be controlled to a lower-pressure side unless fuel is injected from the injector 10. A fuel pressure sensor 41 that detects the fuel pressure PF is provided in the delivery pipe 12, and a detection signal indicative of the fuel pressure PF is supplied to the ECU 2.

A throttle valve 21 is provided in the inlet pipe 4, and the throttle valve 21 is coupled to a TH actuator 22. A degree of opening of the throttle valve 21 is controlled by the ECU 2 through the TH actuator 22, and an amount of intake air GAIR taken into the combustion chamber 3*c* through the throttle valve 21 is controlled. An air flow sensor 42 that detects the amount of intake air GAIR is provided on an upstream side of the inlet pipe 4 relative to the throttle valve 21, and a detection signal indicative of the amount of intake air GAIR is supplied to the ECU 2. Hereinafter, the amount of intake air GAIR detected by the air flow sensor 42 is referred to as an "actual amount of intake air GAIRACT" so as to be distinguished from a target amount of intake air GAIRCMD that will be described later.

A crankshaft 3*d* of the engine 3 is provided with a crank angle sensor 43. The crank angle sensor 43 supplies, to the ECU 2, a CRK signal that is a pulse signal in accordance with rotation of the crankshaft 3*d* for each predetermined crank angle (e.g., 30°). The ECU 2 calculates a rotational speed (hereinafter referred to as an "engine rotational speed") NE of the engine 3 on the basis of the CRK signal.

Furthermore, as illustrated in FIG. 2, the ECU 2 receives, from an accelerator position sensor 44, a detection signal indicative of an accelerator position AP that is an amount of operation of an accelerator pedal (not illustrated) of a vehicle and receives, from a water temperature sensor 45, a detection signal indicative of a temperature (hereinafter referred to as an "engine water temperature") TW of cooling water for cooling a body of the engine 3.

The ECU 2 is a microcomputer that is constituted by a CPU, a RAM, a ROM, an I/O interface (each of which is not illustrated), and the like. The ECU 2 performs various kinds of engine control such as control of fuel injection of the injector 10, control of an ignition timing of the spark plug 11, and control of an amount of intake air of the throttle valve 21, for example, in accordance with a control program stored in the ROM, for example, in response to detection signals supplied from the aforementioned various kinds of sensors 41 to 45.

Especially in the present embodiment, the ECU 2 performs fuel pressure control for setting the target fuel pressure PFCMD and controlling the fuel pressure PF to the target fuel pressure PFCMD. In the present embodiment, the ECU 2 corresponds to a target load acquisition unit, a first target fuel pressure setting unit, a second target fuel pressure setting unit, a fuel pressure control unit, a deceleration determining unit, a first limiting unit, a feedback control unit, and a second limiting unit.

Figure 3:
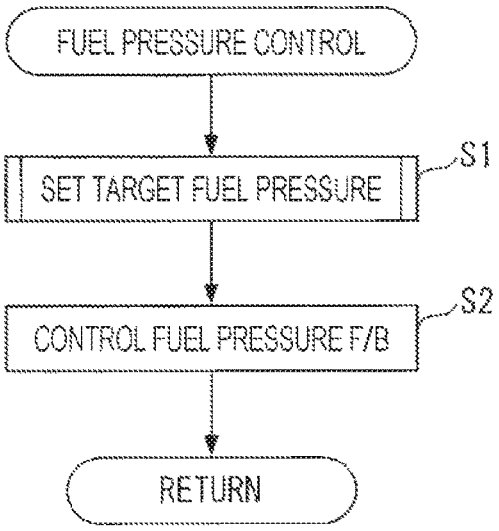
FIG. 3 is a flowchart illustrating a main flow of a fuel pressure control process.

FIG. 3 illustrates a main flow of the fuel pressure control process. This process is repeated on a predetermined cycle. In this process, first, a process for setting a target fuel pressure is performed in Step 1 (illustrated as "S1", the same applies to the following steps). This process is for setting the target fuel pressure PFCMD that is a target of the fuel pressure PF, for example, in accordance with the actual amount of intake air GAIRACT or the target amount of intake air GAIRCMD, and details of this process will be described later.

Next, a fuel pressure feedback control process is performed (Step 2), and the fuel pressure control process is finished. In this process, feedback control is performed through the high-pressure pump 16 so that the fuel pressure PF detected by the fuel pressure sensor 41 becomes the set target fuel pressure PFCMD.

Figure 4:
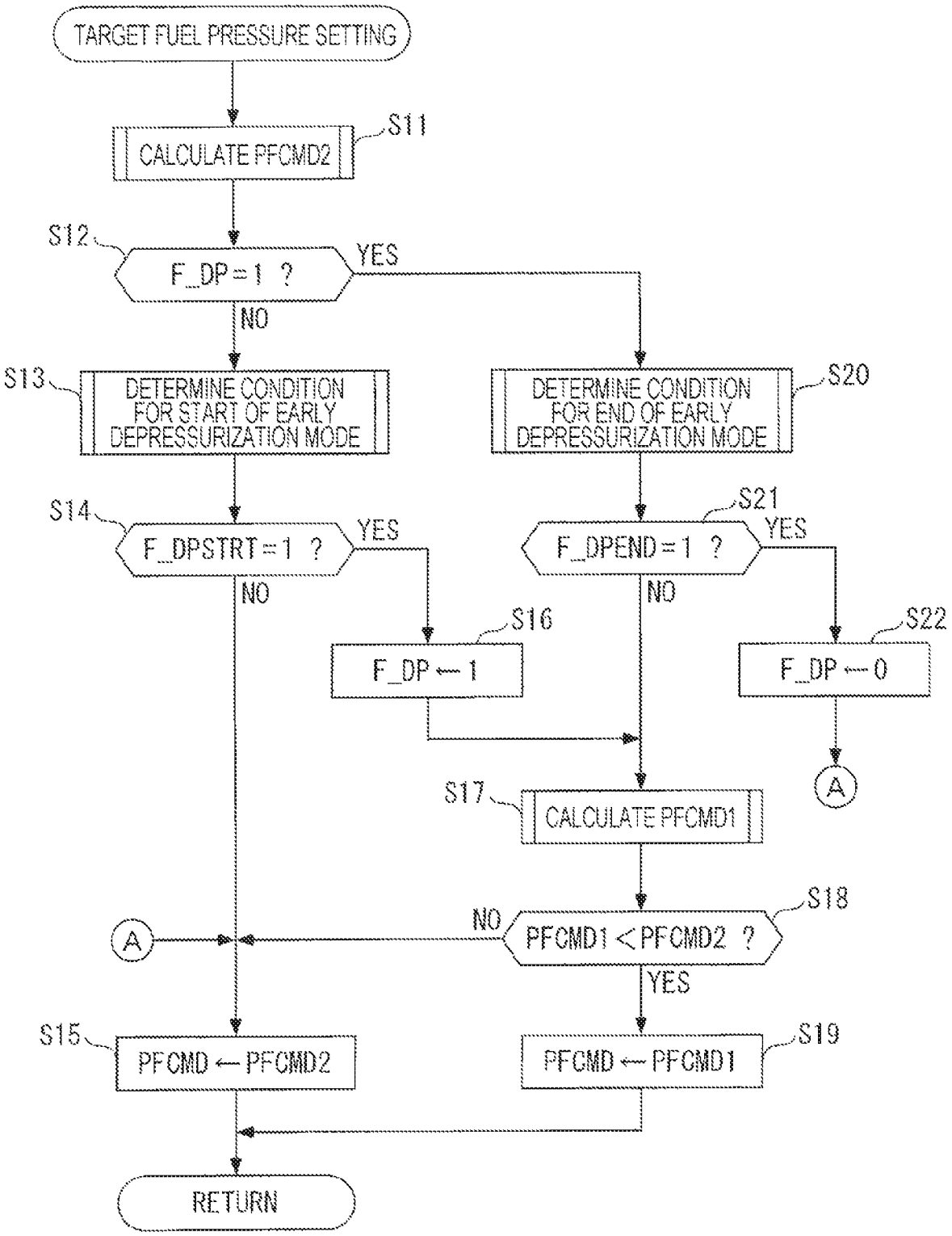
FIG. 4 is a flowchart illustrating a target fuel pressure setting process of the fuel pressure control process.

FIG. 4 illustrates a main flow of the target fuel pressure setting process. The target fuel pressure setting process includes an early depressurization mode for early depressurization of the fuel pressure PF especially during deceleration of the engine 3. In the present embodiment, the early depressurization mode corresponds to target fuel pressure control during deceleration according to the present disclosure.

In this process, first, in Step 11, a target fuel pressure PFCMD2 during a normal state is calculated (set). The target fuel pressure PFCMD2 during a normal state is used as the target fuel pressure PFCMD during normal operation of the engine 3 other than the early depressurization mode. Furthermore, the target fuel pressure PFCMD2 during a normal state is used to decide the target fuel pressure PFCMD in the early depressurization mode by being compared with a target fuel pressure PFCMD1 during early depressurization, as described later.

Figure 5:
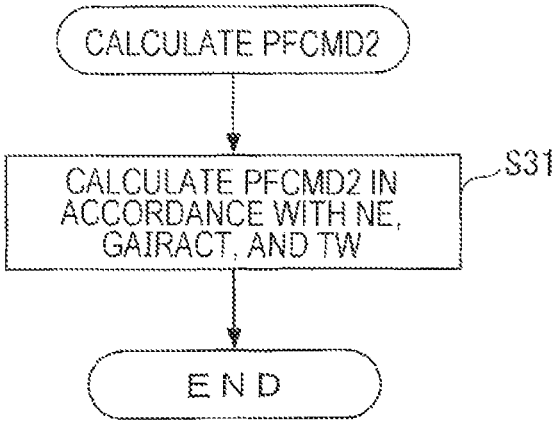
FIG. 5 is a flowchart illustrating a process for calculating a target fuel pressure during a normal state in the target fuel pressure setting process.

The target fuel pressure PFCMD2 during a normal state is calculated in Step 31 of the calculation process illustrated in FIG. 5. Specifically, a map value PFCMD is searched for in accordance with the engine rotational speed NE, the actual amount of intake air GAIRACT that is the amount of intake air GAIR, and the engine water temperature TW that have been detected by using a target fuel pressure map illustrated in FIG. 6, and the map value PFCMD is calculated as the target fuel pressure PFCMD2 during a normal state. In this way, the target fuel pressure PFCMD2 during a normal state is set on the basis of the actual amount of intake air GAIRACT.

See FIG. 4 again. In Step 12 that follows Step 11, it is determined whether or not an early depressurization mode flag F_DP is "1". In a case of NO in Step 12, i.e., during a state other than the early depressurization mode, Step 13 is performed in which a process for determining a condition for start of the early depressurization mode is performed.

Figures 7, 8:
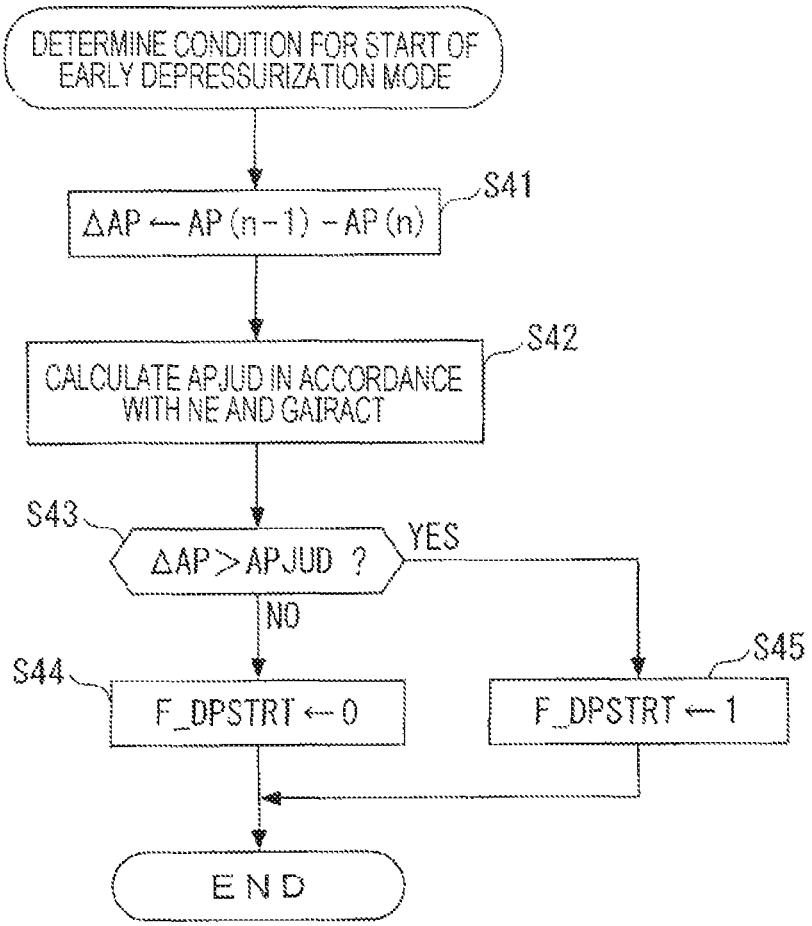
FIG. 7 is a flowchart illustrating a process for determining a condition for start of an early depressurization mode in the target fuel pressure setting process.
FIG. 8 illustrates a judgment value map used in the process for determining a condition for start of an early depressurization mode.

FIG. 7 illustrates a subroutine of the process. In this process, first, in Step 41, a difference between a previous value AP(n−1) and a current value AP(n) of a detected accelerator position is calculated as an accelerator position decrease amount ΔAP. Next, a judgment value APJUD is calculated by searching a judgment value map illustrated in FIG. 8 in accordance with the engine rotational speed NE and the actual amount of intake air GAIRACT (Step 42).

Next, it is determined whether or not the accelerator position decrease amount ΔAP is larger than the judgment value APJUD (Step 43). In a case of NO in Step 43, i.e., in a case where ΔAP is equal to or smaller than APJUD, a speed of decrease of a load of the engine 3 is low, and there is no risk of occurrence of sticking of an injection valve flow amount to a lower limit. Therefore, it is determined that the condition for start of the early depressurization mode has not been established. Accordingly, an early depressurization mode start condition flag F_DPSTRT is set to "0" (Step 44), and this process is finished.

Meanwhile, in a case of YES in Step 43, i.e., in a case where ΔAP is larger than APJUD, the speed of decrease of a load of the engine 3 is high, and there is a risk of occurrence of sticking of an injection valve flow amount to a lower limit. Therefore, it is determined that the condition for start of the early depressurization mode has been established. Accordingly, the early depressurization mode start condition flag F_DPSTRT is set to "1" (Step 45), and this process is finished.

See FIG. 4 again. In Step 14 that follows Step 13, it is determined whether or not the early depressurization mode start condition F_DPSTRT is "1". In a case of NO in Step 14, i.e., in a case where the condition for start of the early depressurization mode has not been established, the target fuel pressure PFCMD2 during a normal state calculated in Step 11 is set as the target fuel pressure PFCMD (Step 15), and this process is finished.

In a case of YES in Step 14, i.e., in a case where the condition for start of the early depressurization mode has been established, it is determined that the early depressurization mode is started, and the early depressurization mode flag F_DP is set to "1" (Step 16). Then, a process for calculating the target fuel pressure PFCMD1 during early depressurization mode is performed in Step 17.

Figure 9:
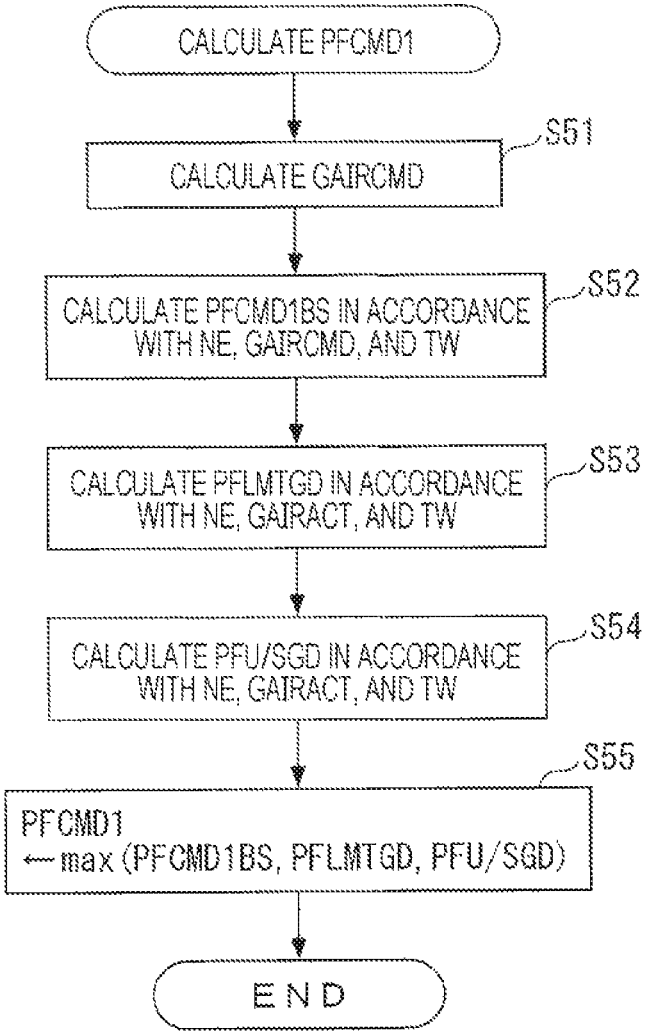
FIG. 9 is a flowchart illustrating a process for calculating a target fuel pressure during early depressurization in the target fuel pressure setting process.

FIG. 9 illustrates a subroutine of the process. In this process, first, in Step 51, the target amount of intake air GAIRCMD is calculated. Specifically, the target amount of intake air GAIRCMD is calculated by searching a predetermined map (not illustrated) in accordance with the engine rotational speed NE and requested torque TRQ requested for the engine 3. The requested torque TRQ is calculated so as to be almost proportional to the accelerator position AP in accordance with the engine rotational speed NE and the accelerator position AP by searching a predetermined map (not illustrated).

Next, a basic target fuel pressure PFCMD1BS that is a basic value of the target fuel pressure PFCMD1 during early depressurization is calculated (set) (Step 52). Specifically, a map value PFCMD is searched for in accordance with the engine rotational speed NE, the target amount of intake air GAIRCMD that is the amount of intake air GAIR, and the engine water temperature TW by using the target fuel pressure map of FIG. 6, and the map value PFCMD is calculated as the basic target fuel pressure PFCMD1BS.

Figure 6:
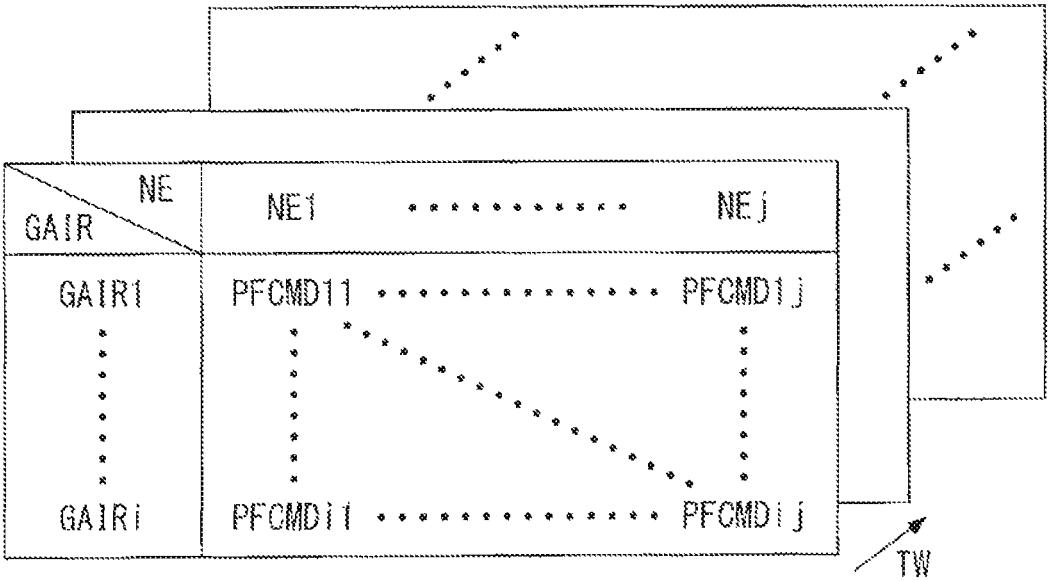

As described above, the target fuel pressure PFCMD2 during a normal state is calculated on the basis of the actual amount of intake air GAIRACT, whereas the basic target fuel pressure PFCMD1BS is calculated on the basis of the target amount of intake air GAIRCMD, and both of the target fuel pressure PFCMD2 during a normal state and the basic target fuel pressure PFCMD1BS are calculated by using the target fuel pressure map of FIG. 6.

Figure 10:
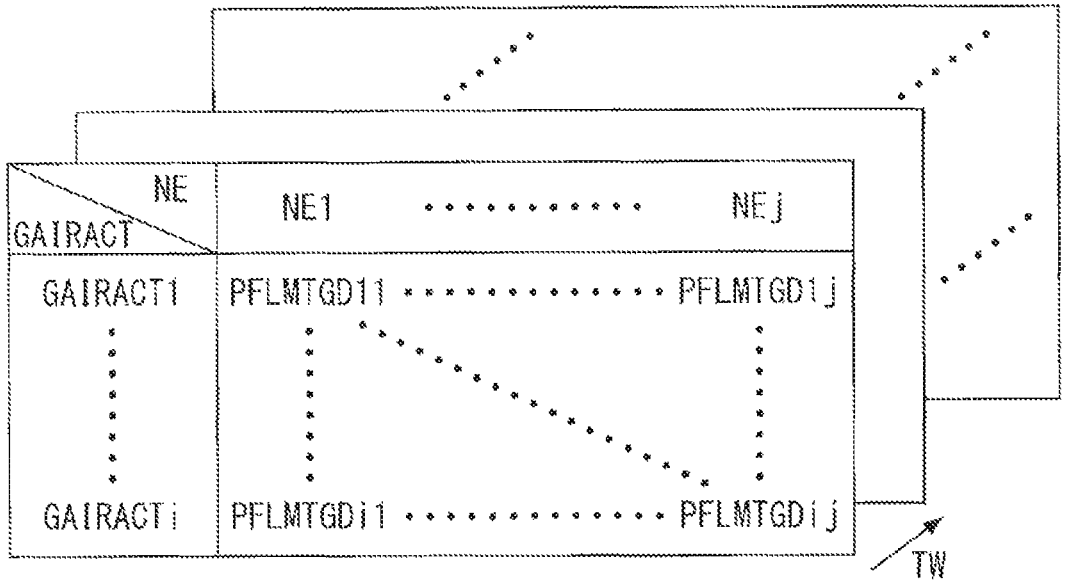
FIG. 10 illustrates an upper limit guard fuel pressure map used in the process for calculating a target fuel pressure during early depressurization.

Next, an upper limit guard fuel pressure PFLMTGD is calculated (Step 53). The upper limit guard fuel pressure PFLMTGD corresponds to an upper limit of a fuel pressure (hereinafter referred to as an "upper limit fuel pressure") that corresponds to an upper limit flow amount during occurrence of sticking of an injection valve flow amount to an upper limit. That is, when the fuel pressure PF becomes lower than the upper limit guard fuel pressure PFLMTGD, sticking of an injection valve flow amount to an upper limit occurs. The upper limit guard fuel pressure PFLMTGD is calculated by searching an upper limit guard fuel pressure map illustrated in FIG. 10 in accordance with the engine rotational speed NE, the actual amount of intake air GAIRACT, and the engine water temperature TW.

Figure 11:
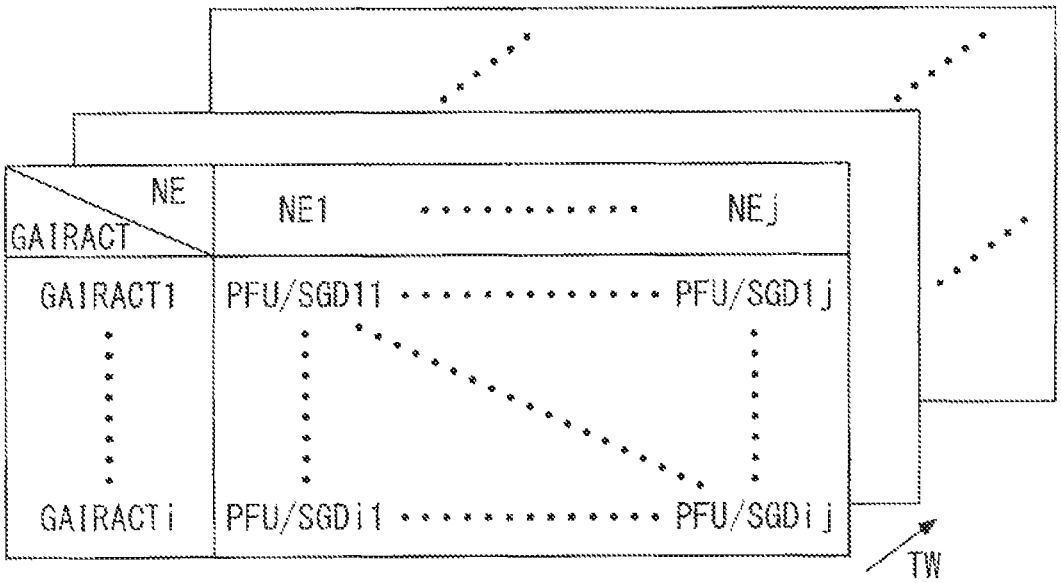
FIG. 11 illustrates a U/S prevention guard fuel pressure map used in the process for calculating a target fuel pressure during early depressurization.

Next, a U/S prevention guard fuel pressure PFU/SGD is calculated (Step 54). When the target fuel pressure PFCMD becomes lower than the U/S prevention guard fuel pressure PFU/SGD, undershoot (U/S) occurs, i.e., the fuel pressure PF feedback-controlled in accordance with the target fuel pressure PFCMD excessively decreases relative to the target fuel pressure PFCMD. The U/S prevention guard fuel pressure PFU/SGD is calculated by searching a U/S prevention guard fuel pressure map illustrated in FIG. 11 in accordance with the engine rotational speed NE, the actual amount of intake air GAIRACT, and the engine water temperature TW.

Next, a highest one of the basic target fuel pressure PFCMD1BS, the upper limit guard fuel pressure PFLMTGD, and the U/S prevention guard fuel pressure PFU/SGD calculated in Steps 52 to 54 is calculated as the target fuel pressure PFCMD1 during early depressurization (Step 55), and this process is finished.

According to Step 55, in a case where the basic target fuel pressure PFCMD1BS is highest among the three fuel pressure parameters, the basic target fuel pressure PFCMD1BS is set as the target fuel pressure PFCMD1 during early depressurization as it is. In a case where the upper limit guard fuel pressure PFLMTGD is highest, the target fuel pressure PFCMD1 during early depressurization is limited to the upper limit guard fuel pressure PFLMTGD. In a case where the U/S prevention guard fuel pressure PFU/SGD is highest, the target fuel pressure PFCMD1 during early depressurization is limited to the U/S prevention guard fuel pressure PFU/SGD.

See FIG. 4 again. In Step 18 that follows Step 17, it is determined whether or not the target fuel pressure PFCMD1 during early depressurization calculated in Step 17 is lower than the target fuel pressure PFCMD2 during a normal state. In a case of NO in Step 18, in a case where PFCMD1 is equal to or higher than PFCMD2, Step 15 is performed in which the target fuel pressure PFCMD is set to the target fuel pressure PFCMD2 during a normal state.

Meanwhile, in a case of YES in Step 18, i.e., in a case where PFCMD1 is lower than PFCMD2, the target fuel pressure PFCMD is set to the target fuel pressure PFCMD1 during early depressurization (Step 19), and this process is finished. As described above, in the early depressurization mode, a lower one of the target fuel pressure PFCMD1 during early depressurization and the target fuel pressure PFCMD2 during a normal state is set as the target fuel pressure PFCMD.

When the early depressurization mode starts, a result of Step 12 is YES, as described above. In this case, Step 20 is performed in which a process for determining a condition for end of the early depressurization mode is performed.

Figure 12:
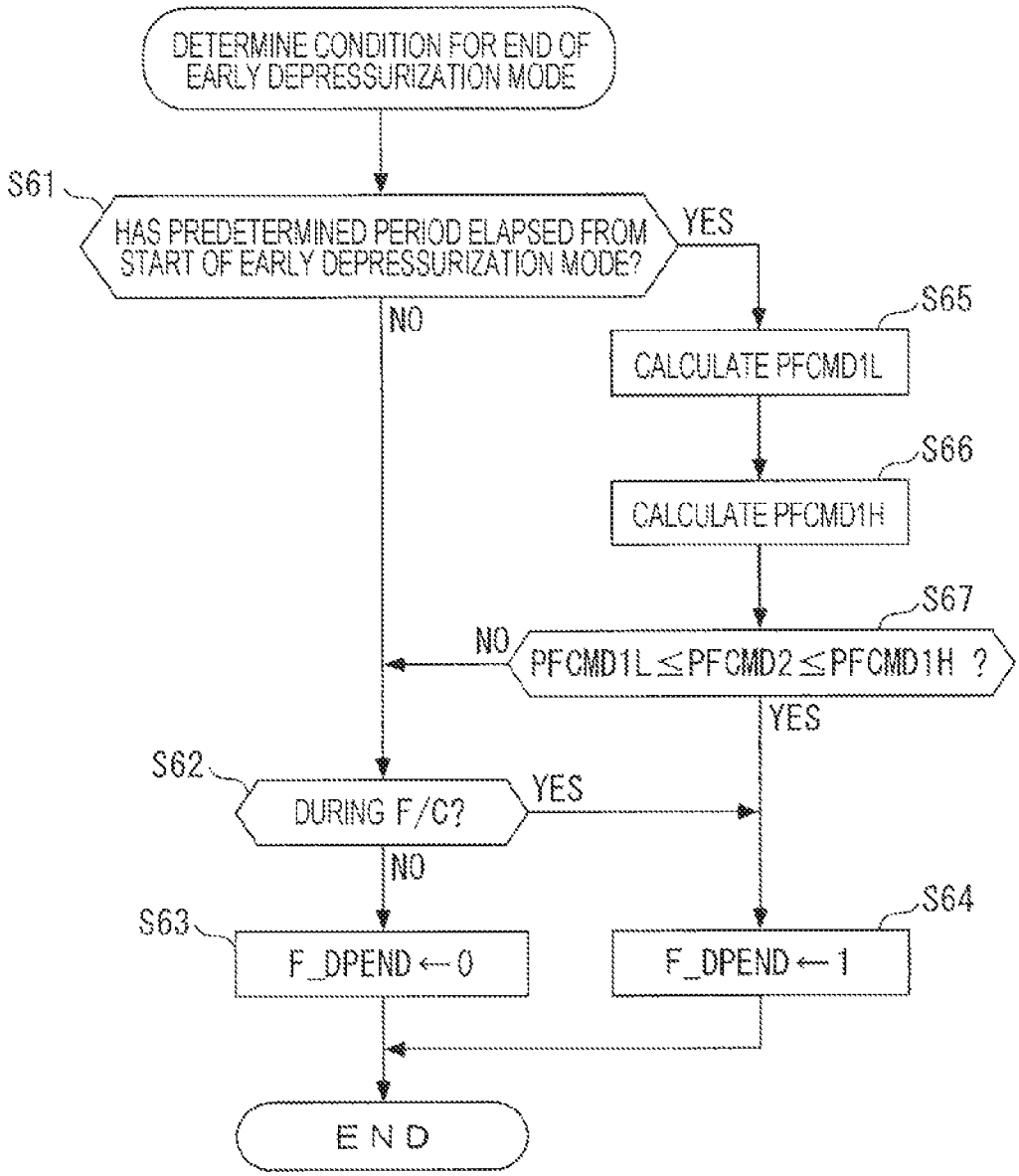
FIG. 12 is a flowchart illustrating a process for determining a condition for end of an early depressurization mode in the target fuel pressure setting process.

FIG. 12 illustrates a subroutine of the process. In this process, first, in Step 61, it is determined whether or not a predetermined period has elapsed after the start of the early depressurization mode. In a case of NO in Step 61, Step 62 is performed in which it is determined whether or not the engine 3 is in fuel cut (F/C) operation in which supply of fuel is stopped. In a case of NO in Step 62, i.e., in a case where the engine 3 is not in fuel cut operation, it is determined that the condition for end of the early depressurization mode has not been established, an early depressurization mode end condition flag F_DPEND is set to "0" (Step 63), and this process is finished.

Meanwhile, in a case of YES in Step 62, i.e., in a case where the engine 3 has shifted to fuel cut operation during deceleration, it is determined that the condition for end of the early depressurization mode has been established, the early depressurization mode end condition flag F_DPEND is set to "1" (Step 64), and this process is finished. A reason why the early depressurization mode is finished in accordance with shift to the fuel cut operation is that fuel injection from the injector 10 is stopped during the fuel cut operation and the high-pressure pump 16 is configured such that control for decreasing the fuel pressure PF cannot be performed unless fuel is injected.

Meanwhile, in a case of YES in Step 61, i.e., in a case where the predetermined period has elapsed after the start of the early depressurization mode, a low-pressure side threshold value PFCMD1L and a high-pressure side threshold value PFCMD1H are calculated in Steps 65 and 66, respectively. The low-pressure side/high-pressure side threshold values PFCMD1L/H define a width of a stationary deviation between the target fuel pressure PFCMD2 during a normal state and the target fuel pressure PFCMD1 during early depressurization that can occur due to a stationary error between the actual amount of intake air GAIRACT and the target amount of intake air GAIRCMD that is caused, for example, by a detection error of the fuel pressure sensor 41.

Specifically, the low-pressure side threshold value PFCMD1L is calculated by searching the target fuel pressure map of FIG. 6 by using, as a GAIR value, a value (=GAIRCMD−ΔGAIRAC) obtained by subtracting a predetermined value ΔGAIRAC indicative of the stationary error from the target amount of intake air GAIRCMD. Similarly, the high-pressure side threshold value PFCMD1H is calculated by searching the target fuel pressure map of FIG. 6 by using, as a GAIR value, a value (=GAIRCMD+ΔGAIRAC) obtained by adding the predetermined value ΔGAIRAC to the target amount of intake air GAIRCMD.

Next, it is determined whether or not the target fuel pressure PFCMD2 during a normal state is in a range defined by the low-pressure side/high-pressure side threshold values PFCMD1L/H (Step 67). In a case of YES in Step 67, the target fuel pressure PFCMD1 during early depressurization and the target fuel pressure PFCMD2 during a normal state are regarded as matching each other even in consideration of a stationary deviation between the target fuel pressure PFCMD1 during early depressurization and the target fuel pressure PFCMD2 during a normal state, it is determined that the condition for end of the early depressurization mode has been established, and Step 64 is performed.

Meanwhile, in a case of NO in Step 67, i.e., in a case where the target fuel pressure PFCMD2 during a normal state is not in the range defined by the low-pressure side/high-pressure side threshold values PFCMD1L/H, it is determined that the target fuel pressure PFCMD1 during early depressurization and the target fuel pressure PFCMD2 during a normal state do not match each other, and Step 62 and subsequent steps are performed in which it is determined whether or not the condition for end of the early depressurization mode has been established in accordance with whether or not the engine 3 is in fuel cut operation.

Next, an example of operation obtained by fuel pressure control according to the present embodiment described above is described with reference to FIGS. 13 through 15. FIG. 13 illustrates an example of basic operation in which the basic target fuel pressure PFCMD1BS is set as the target fuel pressure PFCMD1 during early depressurization as it is without being limited by the upper limit guard fuel pressure PFLMTGD and the U/S prevention guard fuel pressure PFU/SGD.

Figure 13A:
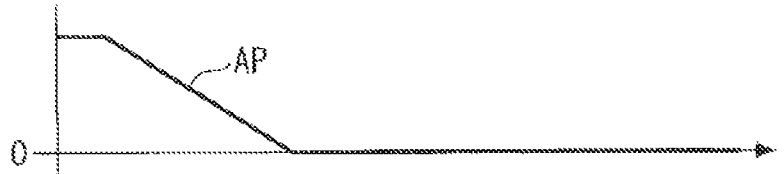
FIGS. 13A to 13C are timing diagrams illustrating an example of operation obtained by fuel pressure control according to the embodiment.

As illustrated in FIG. 13A, when the accelerator position AP decreases due to release of an accelerator pedal and the engine 3 shifts to deceleration operation, the condition for start of the early depressurization mode is established, and the early depressurization mode starts. The target amount of intake air GAIRCMD set in accordance with the accelerator position AP speedily decreases in response to the accelerator position AP (FIG. 13B), and the basic target fuel pressure PFCMD1BS calculated on the basis of the target amount of intake air GAIRCMD also speedily decreases (FIG. 13C).

Figure 13B:
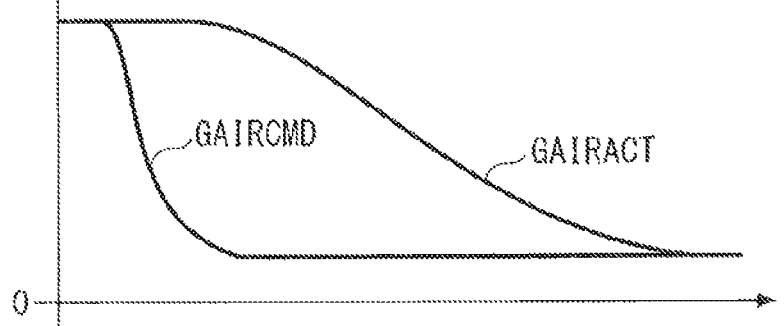
Figure 13C:
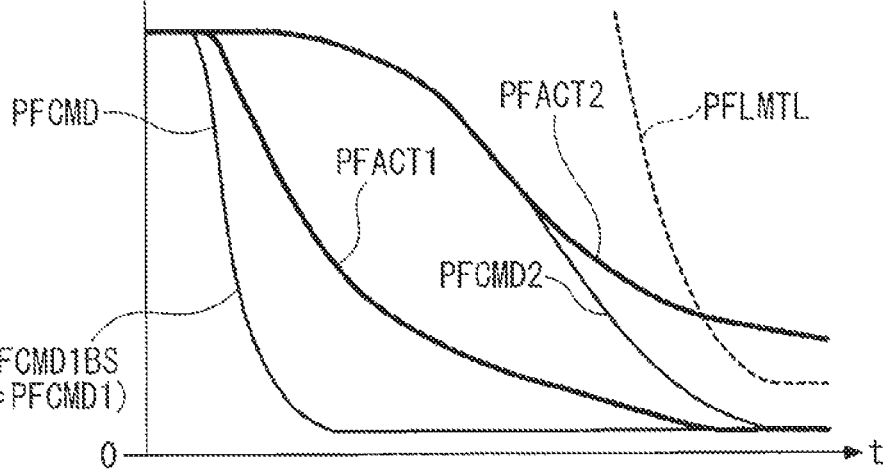

Meanwhile, the actual amount of intake air GAIRACT, which is controlled while using the target amount of intake air GAIRCMD as a target, gradually decreases with relatively large delay from the target amount of intake air GAIRCMD, and the target fuel pressure PFCMD2 during a normal state calculated on the basis of the actual amount of intake air GAIRACT also gradually decreases (FIGS. 13B and 13C). The dotted line in FIG. 13C indicates a lower limit value of a fuel pressure (hereinafter referred to as a "lower limit fuel pressure") PFLMTL at which sticking of an injection valve flow amount to a lower limit occurs.

According to the above relationship, in a case where the basic target fuel pressure PFCMD1BS (=target fuel pressure PFCMD1 during early depressurization) is lower than the target fuel pressure PFCMD2 during a normal state is established and a result of Step 18 of FIG. 4 is YES, the basic target fuel pressure PFCMD1BS is set as the target fuel pressure PFCMD. As a result, as illustrated in FIG. 13C, an actual fuel pressure (hereinafter referred to as a "first actual fuel pressure PFACT1") feedback-controlled while using the basic target fuel pressure PFCMD1BS as a target speedily decreases and is lower than the lower limit fuel pressure PFLMTL even in a final phase of deceleration. This prevents an injection valve flow amount from sticking to a lower limit.

FIG. 13C illustrates, as a comparative example, an actual fuel pressure (hereinafter referred to as a "second actual fuel pressure PFACT2") obtained in a case where the target fuel pressure PFCMD is set to the target fuel pressure PFCMD2 during a normal state. In this case, the second actual fuel pressure PFACT2 decreases more gradually than the first actual fuel pressure PFACT1 and exceeds the lower limit fuel pressure PFLMTL in the final stage of deceleration. As a result, sticking of an injection valve flow amount to a lower limit occurs.

Figures 14A, 14B, 14C:
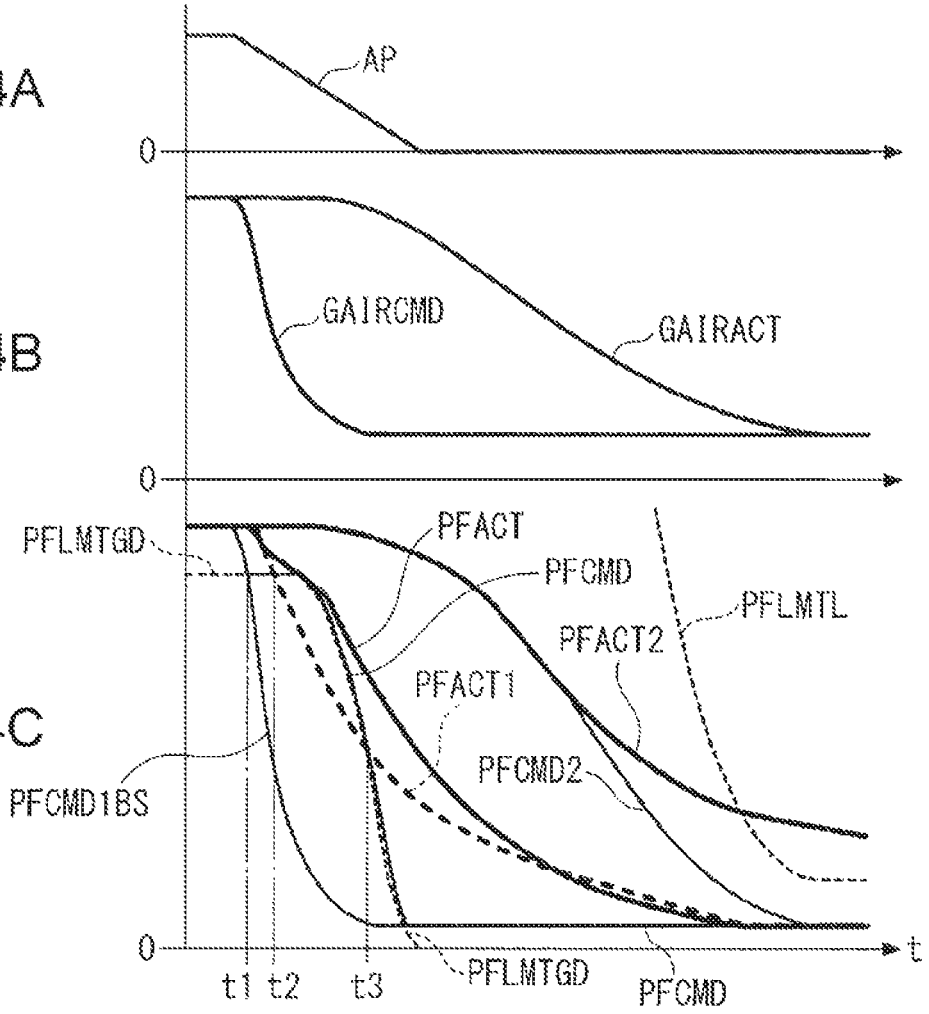
FIGS. 14A to 14C are timing diagrams illustrating another example of operation obtained by fuel pressure control according to the embodiment.

FIG. 14 illustrates an example of operation performed in a case where the target fuel pressure PFCMD1 during early depressurization is limited by the upper limit guard fuel pressure PFLMTGD. The upper limit guard fuel pressure PFLMTGD is indicated by the thin dotted line in a left part of FIG. 14C.

In this example, a relationship that the basic target fuel pressure PFCMD1BS is lower than the upper limit guard fuel pressure PFLMTGD is established in an initial period (t1 to t3) of deceleration, and a reverse relationship is established in other intervals. According to these relationships and the process in Step 55 of FIG. 9, the target fuel pressure PFCMD1 during early depressurization is set to the upper limit guard fuel pressure PFLMTGD in the initial interval as illustrated in FIG. 14C. Meanwhile, in the other intervals, the target fuel pressure PFCMD1 during early depressurization is set to the basic target fuel pressure PFCMD1BS, and the basic target fuel pressure PFCMD1BS is set as the target fuel pressure PFCMD as it is since the basic target fuel pressure PFCMD1BS is lower than the target fuel pressure PFCMD2 during a normal state.

As a result, the actual fuel pressure PFACT that is feedback-controlled while using the target fuel pressure PFCMD as a target gradually decreases without becoming lower than the upper limit guard fuel pressure PFLMTGD in the initial stage of deceleration. This prevents an injection valve flow amount from sticking to an upper limit.

In FIG. 14C, the first actual fuel pressure PFACT1 obtained in a case where the basic target fuel pressure PFCMD1BS is set as the target fuel pressure PFCMD as it is without being limited by the upper limit guard fuel pressure PFLMTGD is indicated by the thick dotted line as a comparative example. In this case, in the initial stage of deceleration, the first actual fuel pressure PFACT1 rapidly decreases corresponding to the basic target fuel pressure PFCMD1BS and is lower than the upper limit guard fuel pressure PFLMTGD (t2 to t3). As a result, sticking of an injection valve flow amount to an upper limit occurs.

Figures 15A, 15B, 15C:
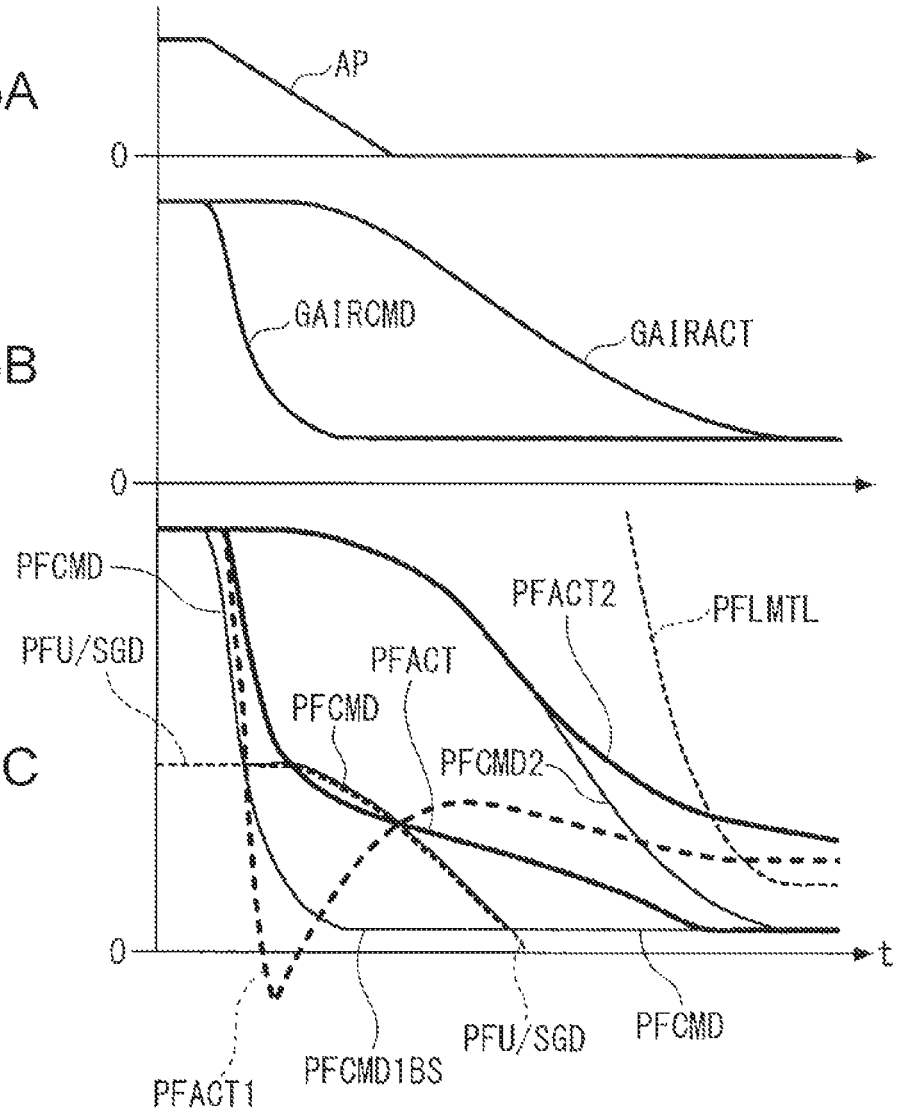
FIGS. 15A to 15C are timing diagrams illustrating another example of operation obtained by fuel pressure control according to the embodiment.

FIG. 15 illustrates an example of operation performed in a case where the target fuel pressure PFCMD1 during early depressurization is limited by the U/S prevention guard fuel pressure PFU/SGD. The U/S prevention guard fuel pressure PFU/SGD is indicated by the thin dotted line in a left part of FIG. 15C.

In this example, a relationship that the basic target fuel pressure PFCMD1BS is lower than the U/S prevention guard fuel pressure PFU/SGD is established in an initial interval of deceleration, and a reverse relationship is established in other intervals. According to these relationships and the process in Step 55 of FIG. 9, the target fuel pressure PFCMD1 during early depressurization is set to the U/S prevention guard fuel pressure PFU/SGD in the initial interval, as illustrated in FIG. 15C. Meanwhile, in the other interval, the target fuel pressure PFCMD1 during early depressurization is set to the basic target fuel pressure PFCMD1BS, and the target fuel pressure PFCMD1BS is set as the target fuel pressure PFCMD as it is since the target fuel pressure PFCMD1BS is lower than the target fuel pressure PFCMD2 during a normal state.

As a result, the actual fuel pressure PFACT that is feedback-controlled while using the target fuel pressure PFCMD as a target does not excessively decrease (does not exhibit undershoot) relative to the target fuel pressure PFCMD and decreases while following the target fuel pressure PFCMD well.

In FIG. 15C, the first actual fuel pressure PFACT1 obtained in a case where the basic target fuel pressure PFCMD1BS is used as the target fuel pressure PFCMD as it is without being limited by the U/S prevention guard fuel pressure PFU/SGD is indicated by the thick dotted line as a comparative example. In this case, the first actual fuel pressure PFACT1, which has followed the basic target fuel pressure PFCMD1BS well, exhibits undershoot and exhibits an excessive increase (overshoot) as a response against the undershoot in an initial stage of deceleration. Furthermore, the first actual fuel pressure PFACT1 exceeds the lower-limit fuel pressure PFLMTL in a final stage of deceleration. As a result, sticking of an injection valve flow amount to a lower limit occurs.

As described above, according to the present embodiment, the target fuel pressure PFCMD1 during early depressurization is calculated on the basis of the target amount of intake air GAIRCMD, the target fuel pressure PFCMD2 during a normal state is calculated on the basis of the actual amount of intake air GAIRACT, and a lower one of the target fuel pressure PFCMD1 during early depressurization and the target fuel pressure PFCMD2 is set as a final target fuel pressure PFCMD during deceleration of the engine 3. As a result, in a normal deceleration state, the target fuel pressure PFCMD is set to a lower target fuel pressure PFCMD1 during early depressurization, and the actual fuel pressure PF speedily decreases accordingly. This makes it possible to prevent an injection valve flow amount from sticking to a lower limit during deceleration.

Furthermore, in a case where deceleration is performed in the middle of an accelerated state or in a case where there is a stationary deviation between the target amount of intake air GAIRCMD and the actual amount of intake air GAIRACT, for example, due to a detection error of the air flow sensor 42, the target fuel pressure PFCMD is set to the target fuel pressure PFCMD2 during a normal state when a relationship that the target fuel pressure PFCMD1 during early depressurization is higher than the target fuel pressure PFCMD2 during a normal state is established in an initial stage of deceleration. It is therefore possible to more speedily decrease the actual fuel pressure PF.

Furthermore, in a case where it is determined that the engine 3 is not in a deceleration state, the target fuel pressure PFCMD is set to the target fuel pressure PFCMD2 during a normal state. This makes it possible to perform stable fuel pressure control based on the actual amount of intake air GAIRACT while using the stable target fuel pressure PFCMD2 during a normal state as the target fuel pressure PFCMD during operation, other than deceleration, in which there is no risk of occurrence of sticking of an injection valve flow amount to a lower limit. Furthermore, since the deceleration state is determined on the basis of the accelerator position decrease amount ΔAP, the determining process can be performed accurately while directly reflecting a driver's decelerating intention.

Furthermore, in a case where the target fuel pressure PFCMD1 during early depressurization and the target fuel pressure PFCMD2 during a normal state match each other in the early depressurization mode, the early depressurization mode is finished, and the target fuel pressure PFCMD is set to the target fuel pressure PFCMD2 during a normal state. This makes it possible to finish the early depressurization mode at an appropriate timing in a case where early depressurization is accomplished by the target fuel pressure PFCMD1 during early depressurization as a result of continuation of deceleration operation or in a case where re-acceleration is performed in the middle of deceleration. Furthermore, since the target fuel pressure PFCMD is set to the target fuel pressure PFCMD2 during a normal state after end of the early depressurization mode, it is possible to switch to stable fuel pressure control based on the actual amount of intake air GAIRACT.

Furthermore, the early depressurization mode is finished not only on a first condition that the target fuel pressure PFCMD1 during early depressurization and the target fuel pressure PFCMD2 during a normal state match each other, but also on a second condition that a predetermined period has elapsed after start of the early depressurization mode. This makes it possible to avoid, with certainty, a situation in which early depressurization mode is instantly finished when the first condition is established, in a case where the target fuel pressure PFCMD1 during early depressurization and the target fuel pressure PFCMD2 during a normal state have not been deviated from each other yet in an initial stage of the early depressurization mode or in a case where the relationship that the target fuel pressure PFCMD1 during early depressurization is lower than the target fuel pressure PFCMD2 during a normal state is established immediately after shift to deceleration in the middle of acceleration.

Furthermore, by applying the upper limit guard fuel pressure PFLMTGD to the target fuel pressure PFCMD1 during early depressurization and thus limiting the target fuel pressure PFCMD1 during early depressurization, it is possible to avoid sticking of an injection valve flow amount to an upper limit with certainty. Furthermore, by applying the U/S prevention guard fuel pressure PFU/SGD to the target fuel pressure PFCMD1 during early depressurization and thus limiting the target fuel pressure PFCMD1 during early depressurization, it is possible to avoid undershoot and overshoot that occurs in response against undershoot in a case where the fuel pressure PF is feedback-controlled to the target fuel pressure PFCMD, thereby making it possible to perform stable feedback control.

The present disclosure is not limited to the embodiment described above and can be modified in various ways. For example, although the amount of intake air GAIR is used as a load of the engine 3 in the embodiment, the present disclosure is not limited to this, and any of other appropriate parameters indicative of a load, such as the requested torque TRQ, the accelerator position AP, an intake pressure, or a degree of opening of the throttle valve 21 may be used.

Furthermore, although a condition for start of the early depressurization mode is determined on the basis of the accelerator position decrease amount ΔAP in the embodiment, a condition for start of the early depressurization mode may be determined on the basis of an amount of decrease of another load parameter of the engine 3, for example, on the basis of an amount of decrease of the requested torque TRQ. In this case, it is possible to more precisely determine a deceleration state on the basis of an amount of decrease of a load of the engine 3 while reflecting a decrease in auxiliary machine load, torque reduction at the time of gear change, or the like, thereby making it possible to more properly prevent an injection valve flow amount from sticking to a lower limit.

In the embodiment, the target fuel pressure PFCMD1 during early depressurization is limited by guard using the U/S prevention guard fuel pressure PFU/SGD in order to prevent undershoot in feedback control. Such undershoot basically occurs when the target fuel pressure PFCMD rapidly decreases and the actual fuel pressure PF follows the target fuel pressure PFCMD well. Accordingly, the target fuel pressure PFCMD1 during early depressurization may be limited by reducing a speed of decrease of the target fuel pressure PFCMD1 during early depressurization.

Furthermore, although the basic target fuel pressure PFCMD1BS and the target fuel pressure PFCMD2 during a normal state are calculated by using a common target fuel pressure map in the embodiment, maps that are different in input-output relation may be created and used for the basic target fuel pressure PFCMD1BS and the target fuel pressure PFCMD2 during a normal state, respectively. Furthermore, although the engine water temperature TW is used as a temperature parameter input to a target fuel pressure map in the embodiment, it is also possible to use any of appropriate temperature parameters such as a temperature of fuel.

Furthermore, although the embodiment is an example in which the present disclosure is applied to a direct-injection type gasoline engine for vehicle, the present disclosure is not limited to this and may be applied to a diesel engine or may be applied to an engine for ship propulsion machine such as an outboard engine in which a crankshaft is disposed vertically or any of other industrial internal-combustion engines. Furthermore, details of the configuration may be changed as appropriate within the scope of the present disclosure. Although a specific form of embodiment has been described above and illustrated in the accompanying drawings in order to be more clearly understood, the above description is made by way of example and not as limiting the scope of the invention defined by the accompanying claims. The scope of the invention is to be determined by the accompanying claims. Various modifications apparent to one of ordinary skill in the art could be made without departing from the scope of the invention. The accompanying claims cover such modifications.

What is claimed is:

1. A fuel injection control device for an internal-combustion engine that directly injects pressurized fuel from a fuel injection valve into a cylinder comprising:

a fuel pressure controller that controls, to a target fuel pressure, a fuel pressure that is a pressure of fuel fed to the fuel injection valve;

a target load acquisition controller that acquires a target load that is a target of a load of the internal-combustion engine;

a first target fuel pressure setting controller that sets a first target fuel pressure on a basis of the acquired target load;

an actual load acquisition controller that acquires an actual load of the internal-combustion engine; and a second target fuel pressure setting controller that sets a second target fuel pressure on a basis of the acquired actual load, wherein the fuel pressure controller performs target-fuel-pressure-control-during-deceleration by setting a lower one of the first target fuel pressure and the second target fuel pressure as the target fuel pressure during deceleration of the internal-combustion engine.

2. The fuel injection control device according to claim 1, further comprising a deceleration determining controller that determines a deceleration state of the internal-combustion engine on a basis of an amount of decrease of a degree of opening of an accelerator pedal or an amount of decrease of requested torque requested for the internal-combustion engine, wherein the fuel pressure controller:

performs the target-fuel-pressure-control-during-deceleration in a case where it is determined that the internal-combustion engine is in the deceleration state, and sets the target fuel pressure to the second target fuel pressure in a case where it is determined that the internal-combustion engine is not in the deceleration state.

3. The fuel injection control device according to claim 1, wherein the fuel pressure controller finishes the target-fuel-pressure-control-during-deceleration and sets the target fuel pressure to the second target fuel pressure in a case:

(i) where the first target fuel pressure and the second target fuel pressure match with each other during the target-fuel-pressure-control-during-deceleration, and (ii) where a predetermined period has elapsed after start of the target-fuel-pressure-control-during-deceleration.

4. The fuel injection control device according to claim 1, further comprising a first limiting controller that limits the first target fuel pressure so that an amount of fuel injection of the fuel injection valve controlled on a basis of the first target fuel pressure does not become lower than an upper limit flow amount of the fuel injection valve.

5. The fuel injection control device according to claim 1, further comprising:

a fuel pressure detector that detects the fuel pressure;

a feedback controller that performs feedback control so that the detected fuel pressure becomes the target fuel pressure; and a second limiting controller that limits the first target fuel pressure so as to avoid an excessive decrease of the fuel pressure relative to the target fuel pressure which is caused by the feedback control.

6. The fuel injection control device according to claim 1, wherein the target load is a target amount of intake air of the internal-combustion engine.

7. The fuel injection control device according to claim 1, wherein the actual load is an actual amount of intake air of the internal-combustion engine.

8. A fuel injection control method for an internal-combustion engine that directly injects pressurized fuel from a fuel injection valve into a cylinder comprising steps of:

(i) controlling by a controller, to a target fuel pressure, a fuel pressure that is a pressure of fuel fed to the fuel injection valve;

(ii) acquiring by the controller a target load that is a target of a load of the internal-combustion engine;

(iii) setting by the controller a first target fuel pressure on a basis of the acquired target load;

(iv) acquiring by the controller an actual load of the internal-combustion engine; and (v) setting by the controller a second target fuel pressure on a basis of the acquired actual load, wherein the step (i) performs target-fuel-pressure-control-during-deceleration by setting a lower one of the first target fuel pressure and the second target fuel pressure as the target fuel pressure during deceleration of the internal-combustion engine.

* * * * *